US009984512B2

(12) United States Patent
Allouche et al.

(10) Patent No.: US 9,984,512 B2
(45) Date of Patent: May 29, 2018

(54) COOPERATIVE VEHICLE MONITORING AND ANOMALY DETECTION

(71) Applicant: INTERNATIONAL BUSINESS MACHINES CORPORATION, Armonk, NY (US)

(72) Inventors: Yair Allouche, Dvira (IL); Yossi Gilad, Tel-Mond (IL); Oded Margalit, Ramat-Gan (IL); Yaron Wolfsthal, Biniamina (IL)

(73) Assignee: International Business Machines Corporation, Armonk, NY (US)

( * ) Notice: Subject to any disclaimer, the term of this patent is extended or adjusted under 35 U.S.C. 154(b) by 111 days.

(21) Appl. No.: 14/991,961

(22) Filed: Jan. 10, 2016

(65) Prior Publication Data

US 2017/0200323 A1 Jul. 13, 2017

(51) Int. Cl.
*G07C 5/00* (2006.01)
*G07C 5/02* (2006.01)

(52) U.S. Cl.
CPC ..... *G07C 5/008* (2013.01); *G07C 5/02* (2013.01)

(58) Field of Classification Search
CPC ..... G07C 5/008; G07C 5/02
See application file for complete search history.

(56) References Cited

U.S. PATENT DOCUMENTS

2010/0207787 A1* 8/2010 Catten ..... G06F 17/30241 340/905
2014/0337976 A1* 11/2014 Moeller ..... H04L 63/1425 726/23
2015/0066239 A1* 3/2015 Mabuchi ..... H04L 63/1408 701/1
2015/0088335 A1* 3/2015 Lambert ..... G08G 1/162 701/1
2015/0195297 A1* 7/2015 Ben Noon ..... B60R 16/023 726/22
2016/0093210 A1* 3/2016 Bonhomme ..... G08G 1/0967 340/905
2016/0197944 A1* 7/2016 Allouche ..... H04L 63/1416 726/23

* cited by examiner

*Primary Examiner* — Dale Moyer
(74) *Attorney, Agent, or Firm* — Dan Swirsky

(57) ABSTRACT

A cooperative vehicle monitoring method including, at an intravehicular monitor configured with each of a plurality of vehicles, gathering any in-vehicle data associated with the vehicle, detecting any intravehicular anomaly associated with the vehicle by analyzing the in-vehicle data, and reporting intravehicular information including any of the detected intravehicular anomaly and the in-vehicle data, and, at an extravehicular monitor, detecting any anomaly by analyzing the reported intravehicular information in combination with extravehicular data that are external to the plurality of vehicles, and reporting any of the intravehicular information, the extravehicular data, and any anomaly detected at the extravehicular monitor.

17 Claims, 4 Drawing Sheets

COOPERATIVE VEHICLE MONITORING AND ANOMALY DETECTION

CROSS-REFERENCE TO RELATED APPLICATIONS

This application claims the benefit of U.S. Provisional Patent Application No. 62/187,825 filed Jul. 2, 2015, the disclosure of which is incorporated herein by reference in its entirety.

BACKGROUND

Modern vehicles are typically controlled and monitored by multiple Electronic Control Units (ECUs) that coordinate their operations by communicating over one or more internal network buses. In addition, modern vehicles are becoming ever more connected through external network interfaces, such as those supporting Radio-frequency Identification (RFID), Bluetooth, Dedicated Short Range Communications (DSRC), Wi-Fi, and cellular communications protocols. This connectivity, on the one hand, facilitates a variety of services including telematics, navigation and safety that provide significant benefits for automakers, aftermarket vendors, fleet managers and passengers. But on the other hand, these capabilities introduce new security and privacy concerns. For example, researchers have highlighted the vulnerability of modern vehicles to cyber-attacks, such as by evading vehicle network defenses and infecting ECUs with malware to control a wide range of essential vehicle functions. Various intravehicular mechanisms for improving security have been proposed by the industry and academia. However, such intravehicular mechanisms are typically limited by inadequate computational and memory resources, access to data within the vehicle and in the vehicle's immediate vicinity only, and often sporadic, unreliable and expensive connectivity with external service providers.

SUMMARY

In one aspect of the invention a method is provided for cooperative vehicle monitoring, the method including, at an intravehicular monitor configured with each of a plurality of vehicles, gathering any in-vehicle data associated with the vehicle, detecting any intravehicular anomaly associated with the vehicle by analyzing the in-vehicle data, and reporting intravehicular information including any of the detected intravehicular anomaly and the in-vehicle data, and, at an extravehicular monitor, detecting any anomaly by analyzing the reported intravehicular information in combination with extravehicular data that are external to the plurality of vehicles, and reporting any of the intravehicular information, the extravehicular data, and any anomaly detected at the extravehicular monitor In other aspects of the invention systems and computer program products embodying the invention are provided.

BRIEF DESCRIPTION OF THE DRAWINGS

Aspects of the invention will be understood and appreciated more fully from the following detailed description taken in conjunction with the appended drawings in which.

DETAILED DESCRIPTION

Figure 1:
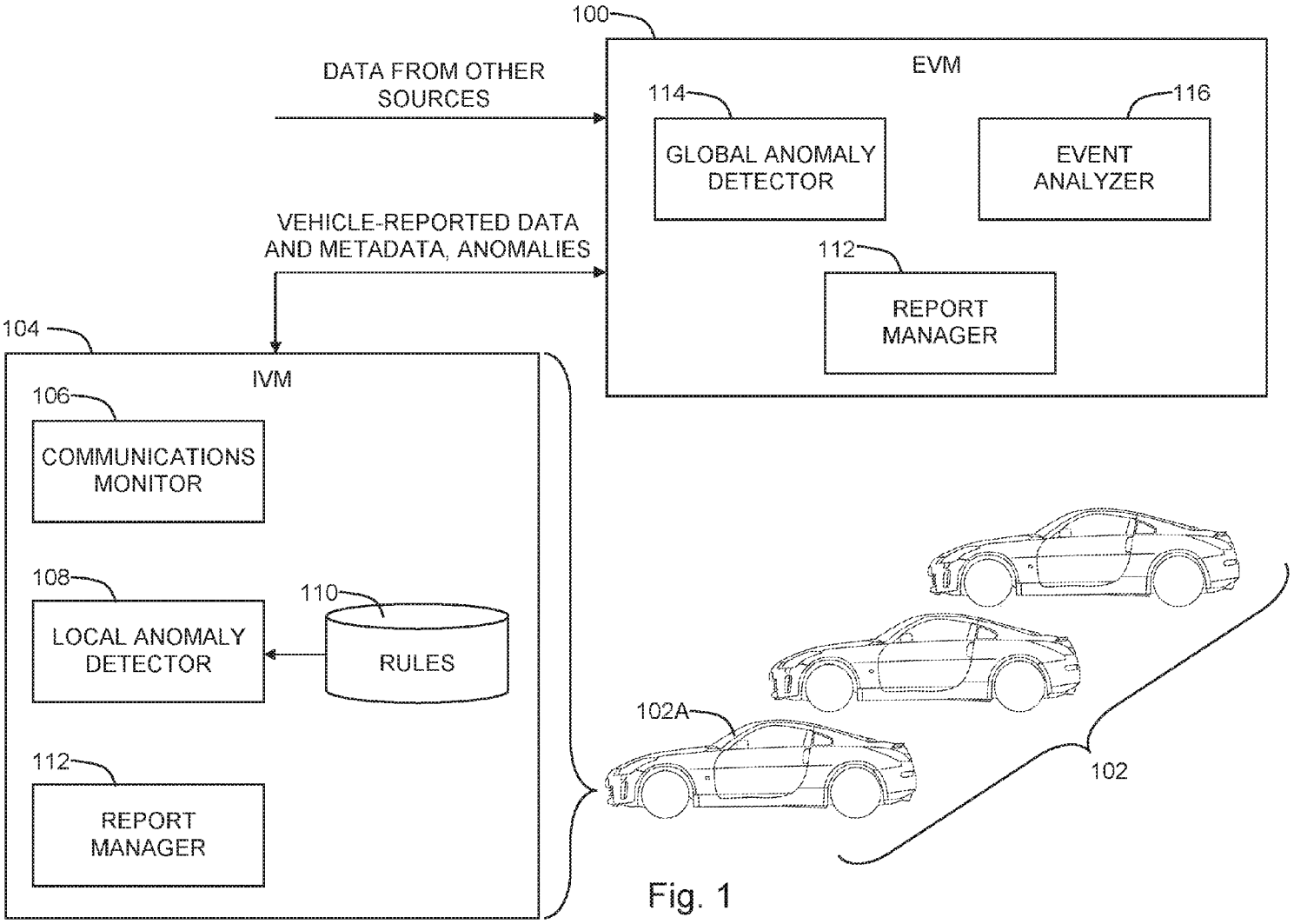
FIG. 1 is a simplified conceptual illustration of a cooperative vehicle monitoring system, constructed and operative in accordance with an embodiment of the invention.

Embodiments of the invention may include a system, a method, and/or a computer program product. The computer program product may include a computer readable storage medium (or media) having computer readable program instructions thereon for causing a processor to carry out aspects of the invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Java, Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the invention.

Aspects of the invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the invention. In this regard, each block in the flowchart or block diagrams may represent a module, segment, or portion of instructions, which comprises one or more executable instructions for implementing the specified logical function (s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Reference is now made to FIG. 1, which is a simplified conceptual illustration of a cooperative vehicle monitoring system, constructed and operative in accordance with an embodiment of the invention. In the system of FIG. 1, an extravehicular monitor (EVM) 100 is shown in wireless communication with one or more vehicles 102, where each of the vehicles, such as a vehicle 102A, is configured with an intravehicular monitor (IVM) 104.

IVM 104 preferably includes a communications monitor (CM) 106 configured to gather in-vehicle data, such as by monitoring communications between components of vehicle 102A, such as between Electronic Control Units (ECUs) of vehicle 102A, communications directed to vehicle 102A from points of origin external to vehicle 102A, and communications from vehicle 102A to recipients external to vehicle 102A.

IVM 104 also preferably includes a local anomaly detector (LAD) 108 configured to detect anomalies associated with vehicle 102A by analyzing the gathered in-vehicle data. In one embodiment LAD 108 applies predefined rules 110 to communications monitored by CM 106 to identify communications that are not in compliance with their associated communication protocols (e.g., CAN, MOST, or LIN), and/or that deviate from expected behavior associated with such communications, such as from an expected message frequency of a given type of communications. In another embodiment LAD 108 acquires data from components of vehicle 102A and applies predefined rules 110, such as kinematic and thermodynamic rules, to identify when such data deviate from expected values, particularly in view of cross-correlations among the data, such as by identifying a gas pedal position that deviates from an expected position given the vehicle's current engine RPM, gear position, and velocity. Such anomalies may, for example, be caused by breakdown of vehicle components, by adverse road and weather conditions, by physical sabotage, or by cyber-attack, such as where malware is introduced to ECUs via external communications or by other means.

IVM 104 also preferably includes a report manager (RM) 112 configured to report information including any of the monitored communications, vehicle data, and detected anomalies described herein, as well as any metadata related thereto, in accordance with conventional reporting techniques. In one embodiment RM 112 reports detected anomalies to persons within vehicle 102A. In another embodiment RM 112 is configured to extract, and optionally compress and/or encrypt, a subset of any of the above information in accordance with predefined reporting protocols, and report the extracted information wirelessly to EVM 100. Redundant data, and data that are known to be in the recipient's possession or otherwise accessible to the recipient, are preferably omitted from reports by RM 112.

EVM 100 preferably includes a global anomaly detector (GAD) 114 configured to detect anomalies associated with any of the vehicles among vehicles 102. Such anomalies may include any of the anomalies described hereinabove with reference to LAD 108, as well as other types of anomalies, such as anomalies regarding elements that are external to vehicles 102, such as current or anticipated road and traffic conditions or automotive service providers affecting or potentially affecting any of vehicles 102. GAD 114 preferably identifies such anomalies by applying known machine learning techniques to the data received from vehicles 102 as described hereinabove, in combination with data that are external to vehicles 102, such as road map information, real-time traffic and weather information, past, current, and planned road repair information, driving rules, traffic and driving models, automotive service provider ratings and history, and automotive component failure statistics. For example Sinai, et al. (M. B. Sinai, N. Partush, S. Yadid, and E. Yahav, "Exploiting Social Navigation," ArXiv Prepr. ArXiv14100151, 2014) describe a method for attacking the WAZE driver assistance application by spoofing traffic jams to influence traffic routing decisions. GAD 114 defends against such an attack by identifying as anomalies injections of false road and traffic data which do not accord with actual real-time traffic and road data.

EVM 100 also preferably includes an event analyzer 116 configured to identify the source or cause of any of the anomalies described hereinabove by applying predefined investigative techniques and rules. In one embodiment, event analyzer 116 identifies anomaly patterns and analyzes the patterns in order to identify commonalities. For example, event analyzer 116 may be configured to identify a particular service shop as the source of an anomaly where multiple vehicles from among vehicles 102 that were recently serviced by the same service shop all began shortly thereafter to exhibit an anomaly with respect to the same third party ECU. Event analyzer 116 is optionally configured to employ predefined forensic techniques to investigate suspected malicious security incidents by retracing the actions of vehicles 102, as well as of elements external to vehicles 102 where such information is available to event analyzer 116, such as by employing IBM Security QRadar Incident Forensics™, commercially available from IBM Corporation, Armonk, N.Y. Event analyzer 116 is optionally configured to employ predefined security vulnerability discovery techniques to proactively discover vehicle security vulnerabilities, such as a vulnerable ECU or network interface, based on any of the anomalies, data, and other findings described hereinabove, as well as suggest and prioritize remediation and mitigation activities related thereto, such as by employing IBM Security QRadar Vulnerability Manager™, commercially available from IBM Corporation, Armonk, N.Y.

EVM 100 also preferably includes a report manager (RM) 118 configured to report information including any of the any of the anomalies, data, and analysis described hereinabove, such as to a security operations center (SoC) analyst or to any of vehicles 102, in accordance with conventional reporting techniques.

Any of the elements shown in FIG. 1 are preferably implemented in computer hardware and/or in computer software embodied in a non-transitory, computer-readable medium in accordance with conventional techniques.

Figure 2A:
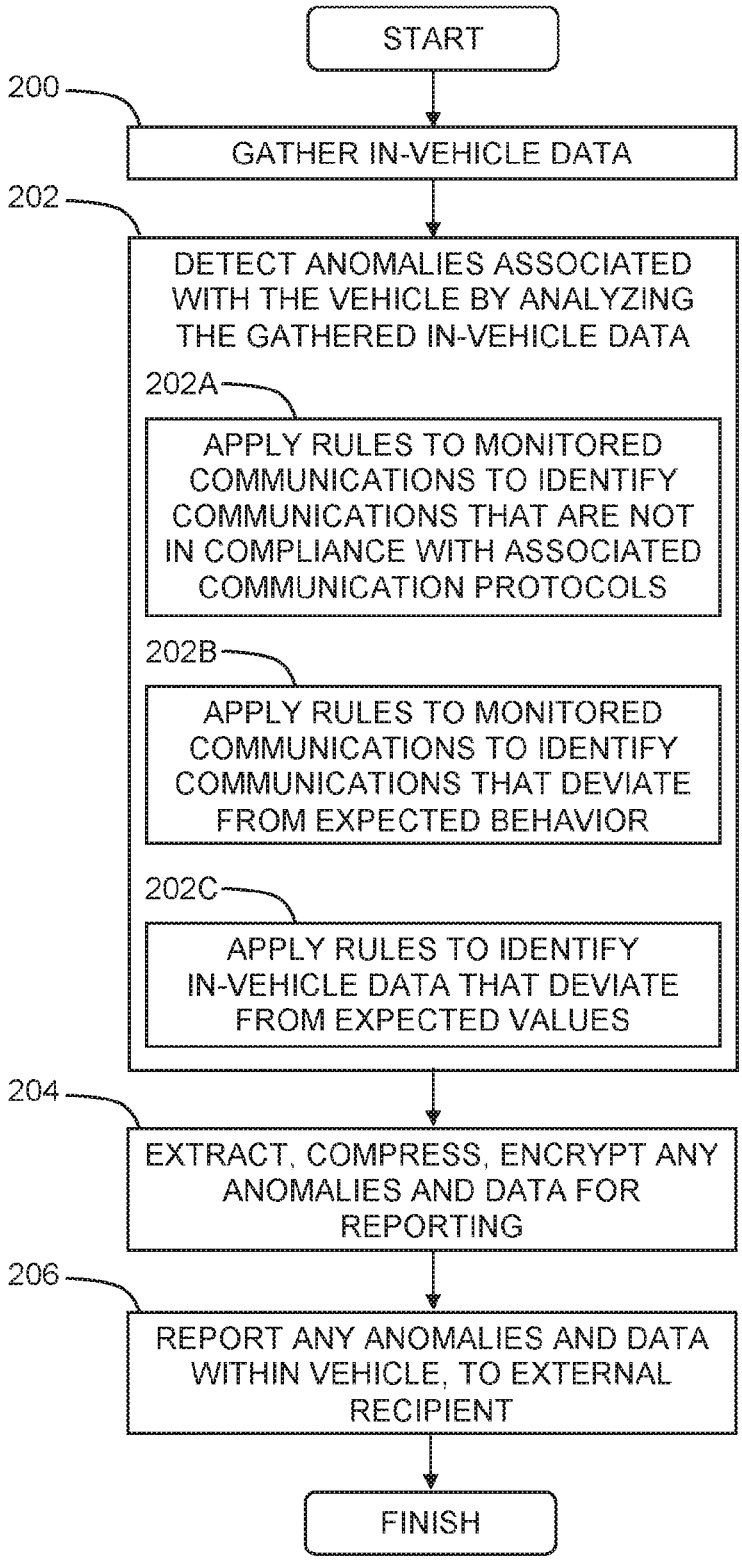
FIG. 2A is a simplified flowchart illustration of an exemplary method of operation of the system of FIG. 1, operative in accordance with an embodiment of the invention.

Reference is now made to FIG. 2A which is a simplified flowchart illustration of an exemplary method of operation of IVM 104 of the system of FIG. 1, operative in accordance with an embodiment of the invention. In the method of FIG. 2A in-vehicle data are gathered, such as by monitoring communications between vehicle components, communications directed to the vehicle from points of origin external to the vehicle, and communications from the vehicle to recipients external to the vehicles (step 200). Anomalies associated with the vehicle are detected by analyzing the gathered in-vehicle data (step 202), such as by applying predefined rules to monitored communications to identify communications that are not in compliance with their associated communication protocols (step 202A), and/or that deviate from expected behavior associated with such communications (step 202B), and/or by applying predefined rules to identify when in-vehicle data deviate from expected values, such as based on data cross-correlations (step 202C). Any of the in-vehicle data, monitored communications, detected anomalies, and related metadata are reported within the vehicle and/or to recipients external to the vehicle, such as to an extravehicular monitor (step 206), where the reported information are optionally extracted, compressed, and/or encrypted first (step 204).

Figure 2B:
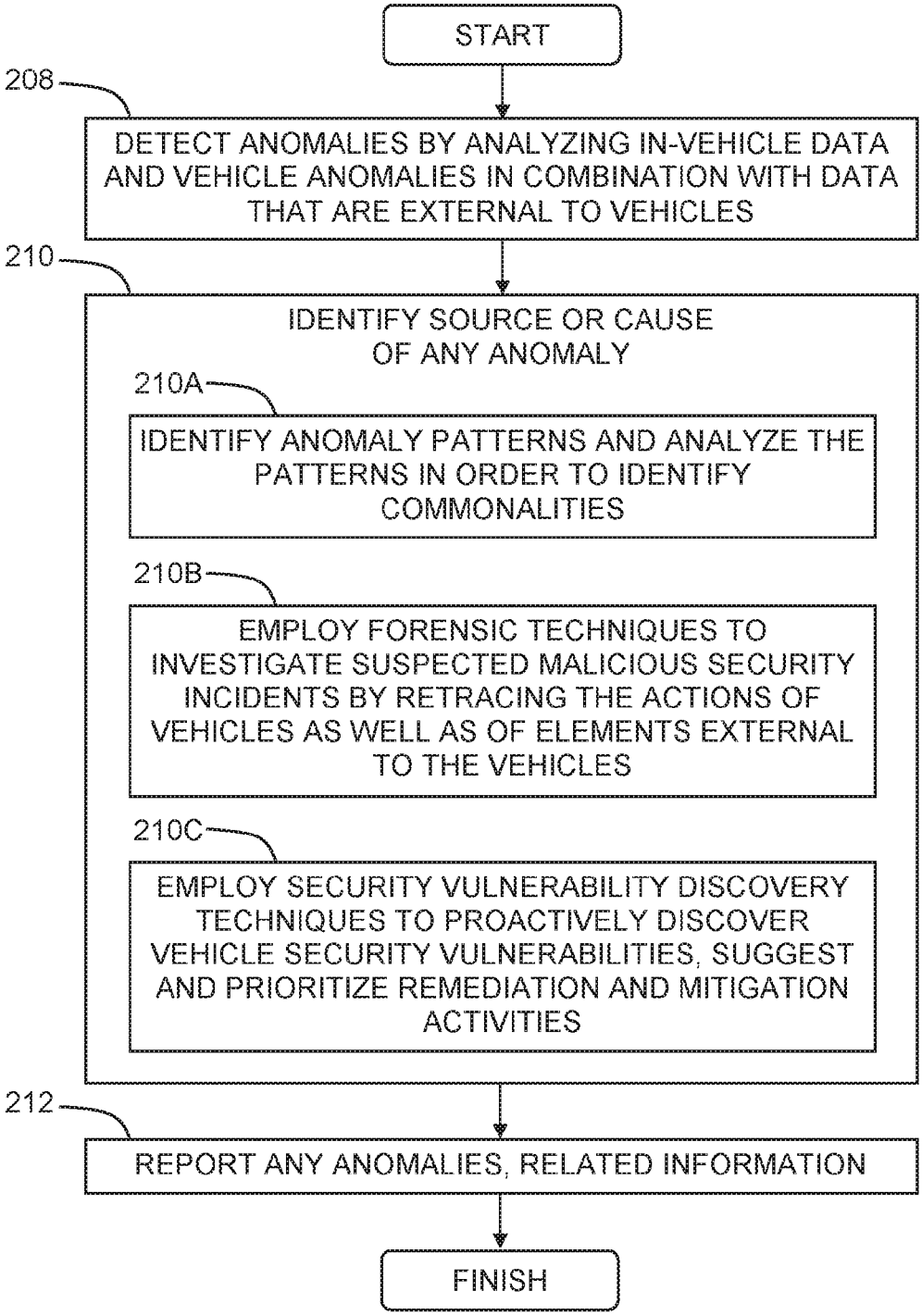
FIG. 2B is a simplified flowchart illustration of an exemplary method of operation of the system of FIG. 1, operative in accordance with an embodiment of the invention.

Reference is now made to FIG. 2B which is a simplified flowchart illustration of an exemplary method of operation of EVM 100 of the system of FIG. 1, operative in accordance with an embodiment of the invention. In the method of FIG. 2B anomalies are detected by analyzing in-vehicle data and anomalies reported by the vehicles in combination with data that are external to the vehicles (step 208). The source or cause of any of the anomalies is identified (step 210), such as by identifying anomaly patterns and analyzing the patterns in order to identify commonalities (step 210A), and/or by employing predefined forensic techniques to investigate suspected malicious security incidents by retracing the actions of the vehicles as well as of elements external to the vehicles (step 210B), and/or by employing predefined security vulnerability discovery techniques to proactively discover vehicle security vulnerabilities as well as suggest and prioritize remediation and mitigation activities related thereto (step 210C). Any of the anomalies, and related information are reported to a security operations center (SoC) analyst and/or to any of vehicles (step 212).

Figure 3:
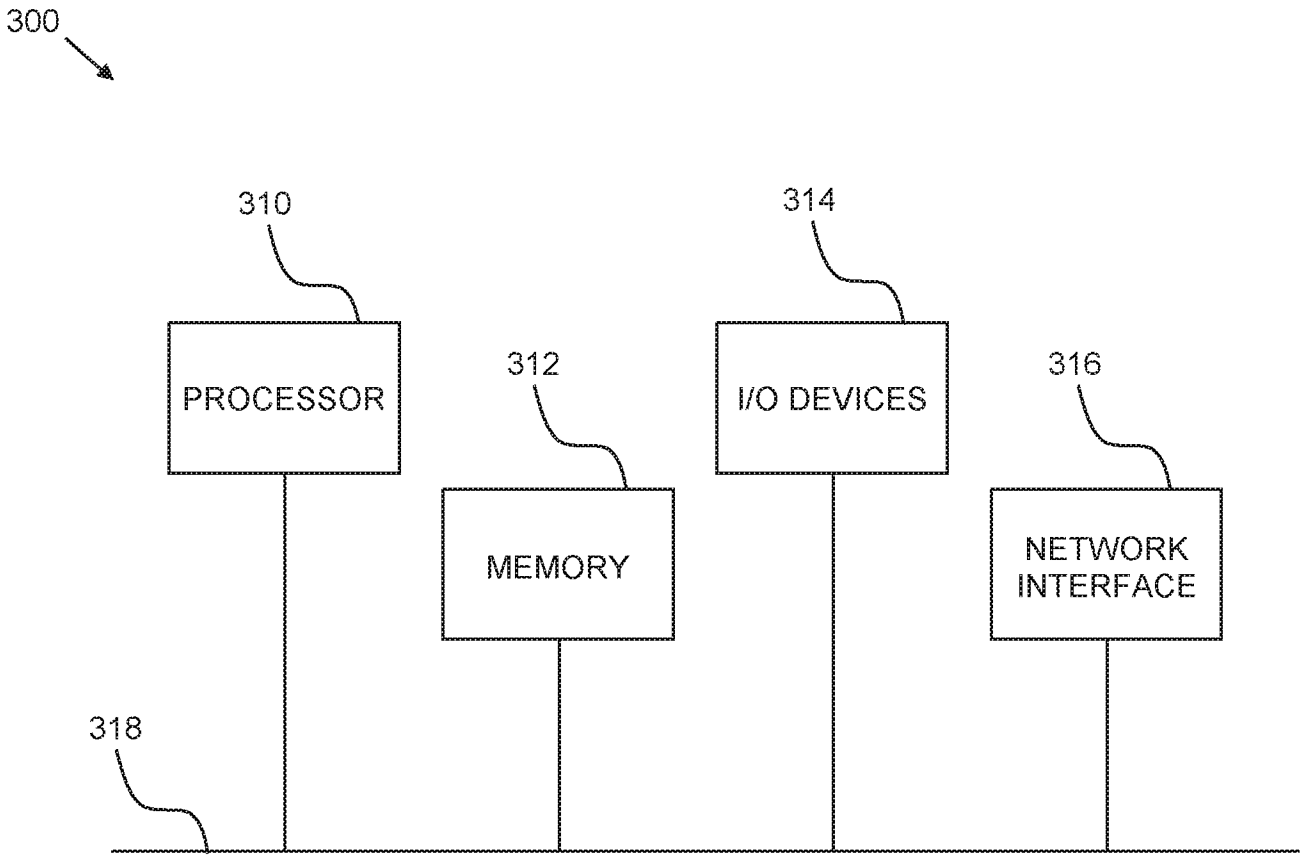
FIG. 3 is a simplified block diagram illustration of an exemplary hardware implementation of a computing system, constructed and operative in accordance with an embodiment of the invention.

Referring now to FIG. 3, block diagram 300 illustrates an exemplary hardware implementation of a computing system in accordance with which one or more components/methodologies of the invention (e.g., components/methodologies described in the context of FIGS. 1-2B) may be implemented, according to an embodiment of the invention.

As shown, the techniques for controlling access to at least one resource may be implemented in accordance with a processor 310, a memory 312, I/O devices 314, and a network interface 316, coupled via a computer bus 318 or alternate connection arrangement.

It is to be appreciated that the term "processor" as used herein is intended to include any processing device, such as, for example, one that includes a CPU (central processing unit) and/or other processing circuitry. It is also to be understood that the term "processor" may refer to more than one processing device and that various elements associated with a processing device may be shared by other processing devices.

The term "memory" as used herein is intended to include memory associated with a processor or CPU, such as, for example, RAM, ROM, a fixed memory device (e.g., hard drive), a removable memory device (e.g., diskette), flash memory, etc. Such memory may be considered a computer readable storage medium.

In addition, the phrase "input/output devices" or "I/O devices" as used herein is intended to include, for example, one or more input devices (e.g., keyboard, mouse, scanner, etc.) for entering data to the processing unit, and/or one or more output devices (e.g., speaker, display, printer, etc.) for presenting results associated with the processing unit.

The descriptions of the various embodiments of the invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A cooperative vehicle monitoring method comprising:

at an intravehicular monitor configured with each of a plurality of vehicles monitoring communications between components of the vehicle, communications directed to the vehicle from points of origin external to the vehicle, and communications from the vehicle to recipients external to the vehicle, gathering any in-vehicle data associated with the vehicle, detecting any intravehicular anomaly associated with the vehicle by analyzing the in-vehicle data, and reporting vehicle-reported intravehicular information, including at least one of a) the detected intravehicular anomaly and b) the in-vehicle data, to a recipient that is external to the plurality of vehicles; and at an extravehicular monitor that is external to the plurality of vehicles, receiving the vehicle-reported intravehicular information, receiving from a source other than the plurality of vehicles, other-source extravehicular data that are external to the plurality of vehicles, detecting any anomaly by analyzing the vehicle-reported intravehicular information in combination with the other-source extravehicular data that are external to the plurality of vehicles, and reporting any of the intravehicular information, the extravehicular data, and any anomaly detected at the extravehicular monitor.

2. The method according to claim 1 wherein the detecting comprises detecting by applying predefined rules to the monitored communications to identify any communications not in compliance with communication protocols associated with the monitored communications.

3. The method according to claim 1 wherein the detecting comprises detecting by applying predefined rules to the monitored communications to identify any communications that deviate from expected behavior associated with the monitored communications.

4. The method according to claim 1 wherein the detecting comprises detecting by applying predefined rules to identify any of the data that deviate from expected values.

5. The method according to claim 1 and further comprising identifying anomaly patterns among the anomalies and analyzing the anomaly patterns to identify any commonalities.

6. The method according to claim 1 wherein the gathering, detecting, and reporting are implemented in any of a) computer hardware, and b) computer software embodied in a non-transitory, computer-readable medium.

7. A cooperative vehicle monitoring method comprising:

configuring each of a plurality of vehicles with an intravehicular monitor configured to monitor communications between components of the vehicle communications directed to the vehicle from points of origin external to the vehicle and communications from the vehicle to recipients external to the vehicle, gather any in-vehicle data associated with the vehicle, detect any intravehicular anomaly associated with the vehicle by analyzing the in-vehicle data, and report vehicle-reported intravehicular information, including at least one of a) the detected intravehicular anomaly and b) the in-vehicle data, to a recipient that is external to the plurality of vehicles; and at an extravehicular monitor that is external to the plurality of vehicles, receiving the vehicle-reported intravehicular information, receiving from a source other than the plurality of vehicles, other-source extravehicular data that are external to the plurality of vehicles, detecting any anomaly by analyzing the vehicle-reported intravehicular information in combination with the other-source extravehicular data that are external to the plurality of vehicles, and reporting any of the intravehicular information, the extravehicular data, and any anomaly detected at the extravehicular monitor.

8. The method according to claim 7 wherein the configuring comprises configuring wherein the intravehicular monitor is configured to detect any intravehicular anomaly by applying predefined rules to the monitored communications to identify any communications not in compliance with communication protocols associated with the monitored communications.

9. The method according to claim 7 wherein the configuring comprises configuring wherein the intravehicular monitor is configured to detect any intravehicular anomaly by applying predefined rules to the monitored communications to identify any communications that deviate from expected behavior associated with the monitored communications.

10. The method according to claim 7 wherein the configuring comprises configuring wherein the intravehicular monitor is configured to detect any intravehicular anomaly by applying predefined rules to identify any of the data that deviate from expected values.

11. The method according to claim 7 and further comprising identifying anomaly patterns among the anomalies and analyzing the anomaly patterns to identify any commonalities.

12. The method according to claim 7 wherein the detecting and reporting are implemented in any of a) computer hardware, and b) computer software embodied in a non-transitory, computer-readable medium.

13. A cooperative vehicle monitoring system comprising:

an intravehicular monitor configured with each of a plurality of vehicles, wherein the intravehicular monitor is configured to monitor communications between components of the vehicle, communications directed to the vehicle from points of origin external to the vehicle, and communications from the vehicle to recipients external to the vehicle, gather any in-vehicle data associated with the vehicle, detect any intravehicular anomaly associated with the vehicle by analyzing the in-vehicle data, and report vehicle-reported intravehicular information, including at least one of a) the detected intravehicular anomaly and b) the in-vehicle data, to a recipient that is external to the plurality of vehicles; and at an extravehicular monitor that is external to the plurality of vehicles, receive the vehicle-reported intravehicular information, receive from a source other than the plurality of vehicles, other-source extravehicular data that are external to the plurality of vehicles, detect any anomaly by analyzing the vehicle-reported intravehicular information in combination with the other-source extravehicular data that are external to the plurality of vehicles, and report any of the intravehicular information, the extravehicular data, and any anomaly detected at the extravehicular monitor.

14. The system according to claim 13 wherein the intravehicular monitor is configured to apply predefined rules to the monitored communications to identify any communications not in compliance with communication protocols associated with the monitored communications.

15. The system according to claim 13 wherein the intravehicular monitor is configured to apply predefined rules to the monitored communications to identify any communications that deviate from expected behavior associated with the monitored communications.

16. The system according to claim 13 wherein the intravehicular monitor is configured to apply predefined rules to identify any of the data that deviate from expected values.

17. The system according to claim 13 wherein the intravehicular monitor and extravehicular monitor are implemented in any of a) computer hardware, and b) computer software embodied in a non-transitory, computer-readable medium.

* * * * *